US008770678B2

(12) United States Patent
Ton

(10) Patent No.: US 8,770,678 B2
(45) Date of Patent: Jul. 8, 2014

(54) WORK STATIONS FOR MANICURISTS

(76) Inventor: Quy That Ton, Baton Rouge, LA (US)

( * ) Notice: Subject to any disclaimer, the term of this patent is extended or adjusted under 35 U.S.C. 154(b) by 183 days.

(21) Appl. No.: 12/706,623

(22) Filed: Feb. 16, 2010

(65) Prior Publication Data

US 2010/0200010 A1 Aug. 12, 2010

Related U.S. Application Data

(63) Continuation-in-part of application No. 12/354,852, filed on Jan. 16, 2009, now abandoned.

(60) Provisional application No. 61/011,281, filed on Jan. 16, 2008.

(51) Int. Cl.
*E06B 3/50* (2006.01)
*A45D 29/18* (2006.01)
*B26B 13/22* (2006.01)

(52) U.S. Cl.
USPC ..... 312/109; 312/209; 132/73.5

(58) Field of Classification Search
USPC ..... 312/194–197, 209–212, 229, 236, 312/266–269; 132/73–76.5; 454/49, 56; 55/DIG. 18
See application file for complete search history.

(56) References Cited

U.S. PATENT DOCUMENTS 776,519 A * 12/1904 Kelsey ..... 312/209
1,757,398 A 5/1930 Squires
2,147,314 A 2/1939 Percy
2,657,811 A 11/1953 Isler
3,013,852 A * 12/1961 Rockola ..... 312/223.5
3,078,133 A 2/1963 Schauer
3,464,567 A 9/1969 Hoppel et al.
3,597,033 A 8/1971 Slouka
3,784,270 A * 1/1974 DeLapp ..... 312/236
D234,658 S 4/1975 Tillinger
4,252,054 A * 2/1981 Bakels ..... 433/92
4,280,519 A * 7/1981 Chapman ..... 132/73.5
4,329,002 A 5/1982 Cowen et al.
4,852,468 A * 8/1989 Harris ..... 454/56
4,898,089 A * 2/1990 Roos ..... 454/49
5,139,546 A * 8/1992 Novobilski ..... 96/142
5,276,938 A * 1/1994 Cadwell et al. ..... 15/302
D364,767 S 12/1995 McLinden
5,536,081 A * 7/1996 Pokhis ..... 312/321.5
5,787,903 A * 8/1998 Blackshear ..... 132/73.5
5,807,414 A * 9/1998 Schaefer ..... 55/385.2
6,698,360 B2 * 3/2004 Park ..... 108/50.13
6,826,848 B1 * 12/2004 Delaney et al. ..... 34/90
7,310,228 B2 * 12/2007 Chen ..... 361/695
D570,131 S * 6/2008 Trinh ..... D6/422
7,490,914 B2 2/2009 Greiner (Continued)

*Primary Examiner* — Darnell Jayne
*Assistant Examiner* — Timothy M Ayres
(74) *Attorney, Agent, or Firm* — Minh N. Nguyen; Next IP Law Group LLP

(57) ABSTRACT

A representative work station comprises a center console module having front, rear, top, and bottom walls. The front wall includes at least one hole for storing at least one nail drying device. The top wall includes a first airflow device for producing airflow from the outside to the inside of the center console module. The center console module further comprises a tray that is positioned below the first airflow device and receives particles from the first airflow device. At least two end modules are coupled to the center console module. The at least two end modules include a first end module that receives the particles from the tray.

14 Claims, 10 Drawing Sheets

(56) References Cited

U.S. PATENT DOCUMENTS

| | | | | |
|---|---|---|---|---|
| D647,724 | S * | 11/2011 | Hernandez et al. | D6/422 |
| 2006/0151408 | A1 * | 7/2006 | Gaynor | 211/74 |
| 2006/0217053 | A1 * | 9/2006 | Cardwell | 454/66 |
| 2008/0143223 | A1 * | 6/2008 | Schuller | 312/236 |
| 2008/0199354 | A1 * | 8/2008 | Gordon | 422/24 |
| 2008/0216647 | A1 * | 9/2008 | Phan | 95/8 |
| 2008/0223384 | A1 | 9/2008 | Lidor Zabari | |
| 2009/0016017 | A1 * | 1/2009 | Yu et al. | 361/687 |

* cited by examiner

WORK STATIONS FOR MANICURISTS

CROSS-REFERENCE TO RELATED APPLICATION

This application is a continuation-in-part of U.S. patent application entitled, "WORK STATIONS FOR MANICURISTS," having Ser. No. 12/354,852, filed on Jan. 16, 2009, which claims priority to U.S. provisional application entitled "MODULAR MANCURIST STATION," having Ser. No. 61/011,281, filed on Jan. 16, 2008, the entirety of both applications are hereby incorporated by reference herein.

TECHNICAL FIELD

The present disclosure is generally related to work stations and, more particularly, is related to work stations for manicurists.

BACKGROUND

In the nail industry, a nail technician keeps multiple nail products and grooming supplies at a work station. However, the nail products and grooming supplies often get lost in crowded countertops or drawers and result in spills. Further, customers typically go from one station to another for different procedures. For example, a customer sits at a nail technician desk for various manicuring applications and then sits at a drying station remote from the nail technician desk.

SUMMARY

A representative work station comprises a center console module having front, rear, top, and bottom walls. The front wall includes at least one hole for storing at least one nail drying device. The top wall includes a first airflow device for producing airflow from the outside to the inside of the center console module. The center console module further comprises a tray that is positioned below the first airflow device and receives particles from the first airflow device. At least two end modules are coupled to the center console module. The at least two end modules include a first end module that receives the particles from the tray.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Exemplary work stations are first discussed with reference to the figures. Although these work stations are described in detail, they are provided for purposes of illustration only and various modifications are feasible.

Figure 1:
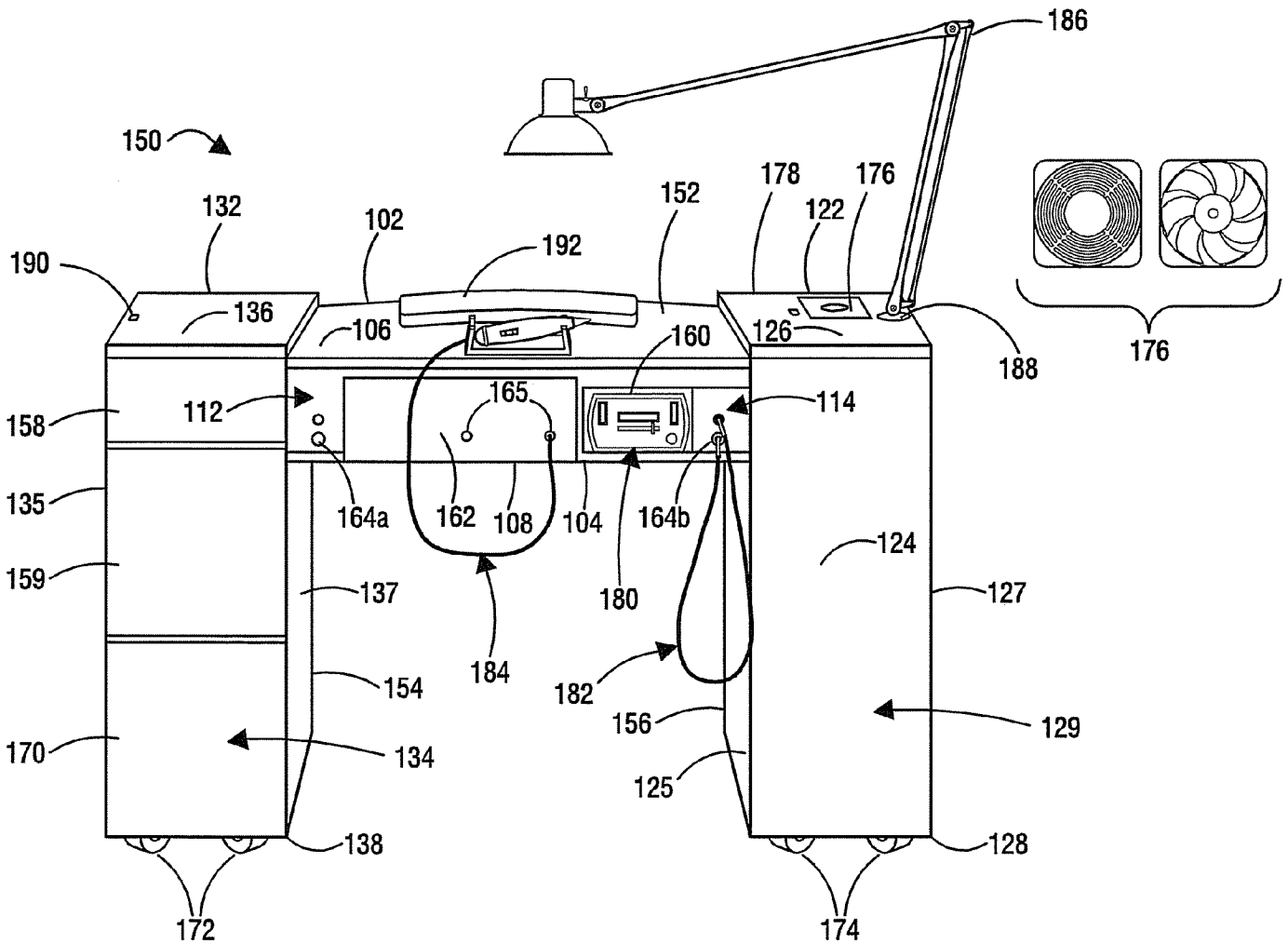
FIG. 1 is a rear view of an embodiment of a work station in accordance with the disclosure.

FIG. 1 is a rear view of an embodiment of a work station 150 in accordance with the disclosure. The work station 150 includes a center console module 152 having front wall 102, rear wall 104, top wall 106, and bottom wall 108. The top wall 106 of the center console module 152 includes an arm rest 192 placed adjacent to the front wall 102 of the center console module 152. The rear wall 104 includes holes 164*a*, 164*b* at the proximal end 112 and distal end 114 for storing, e.g., a nail drill device 182 and other devices that should be appreciated by a person of ordinary skill in the art. The holes 164*a*, 164*b* have diameters such that either electrical wires and/or the nail drill device can pass through them. The rear wall 104 further includes an opening 160 for housing, e.g., a control unit 180 of a nail drill device and other devices that should be appreciated by a person of ordinary skill in the art. The opening 160 has a height that is substantially the height of the rear wall 104.

In this example, the opening 160 is adjacent to the holes 164*b* at the distal end 114 of the center console module 152. The rear wall 104 further includes a drawer 162 positioned between the holes 164*a*, 164*b* at the proximal end 112 and distal end 114. The drawer 162 can store nail drill device (not shown) and includes holes 165 that allows extendable or telescoping attachments 184, e.g., electrical wires, to extend outside of the drawer 162. It should be appreciated that the drawer 162 and opening 160 can be configured to house or store various tools and other devices that can be employed by a manicurist in the manicuring process. It should also be appreciated that holes 164*a*, 164*b*, 165 may be used for extendable or telescoping attachments or any apparatus configured to work in conjunction with other manicurist devices housed in the opening 160 and/or drawer 162. The work station 150 further includes two end modules 154, 156 that are coupled to the center console module 152, forming a "U" shape configuration.

The end modules 154, 156 may be attached to the center console module 152 using connecting devices or apparatuses that should be appreciated by a person of ordinary skill in the art. Such connecting devices may include, but are not limited to: dowels, screws, hinges, tongue and groove fasteners, or other connecting devices that are known in the art. The center console module 152 can be connected to various end modules other than the end modules 154, 156 shown in FIG. 1, which are further describe in relation to FIGS. 3 and 6-8.

The end module 156 includes front wall 122, rear wall 124, top wall 126, bottom wall 128, left and right side walls 125, 127. The top wall is attached with a fan and having at least one hole 188 for hanging a lamp 186 or drill (not shown). The bottom wall 128 is coupled to transporting mechanisms 174, such as casters, which allows the entire modular table 150 to be portable. It should be appreciated that such transporting mechanism may include, but not limited to, casters, wheels, or other transporting mechanisms known to a person of ordinary skill in the art. The rear wall includes a cabinet 129, which is further described in relation to FIG. 6. The top wall 126 includes a cut-out portion in which a fan 176 can be placed inside the cut-out portion such that the fan 176 is flush with the top surface 178 of the top wall 126.

The end module 154 includes front wall 132, rear wall 134, top wall 136, bottom wall 138, left and right side walls 135, 137. The top wall 136 includes at least one hole 190 for hanging a lamp or drill (not shown). The bottom wall 138 is coupled to transporting mechanisms 172. The rear wall 134 includes three drawers 158, 159, 170 for storing at least one of the following: buffing blocks, files, tools, bottles, cotton, and trash.

Figure 2:
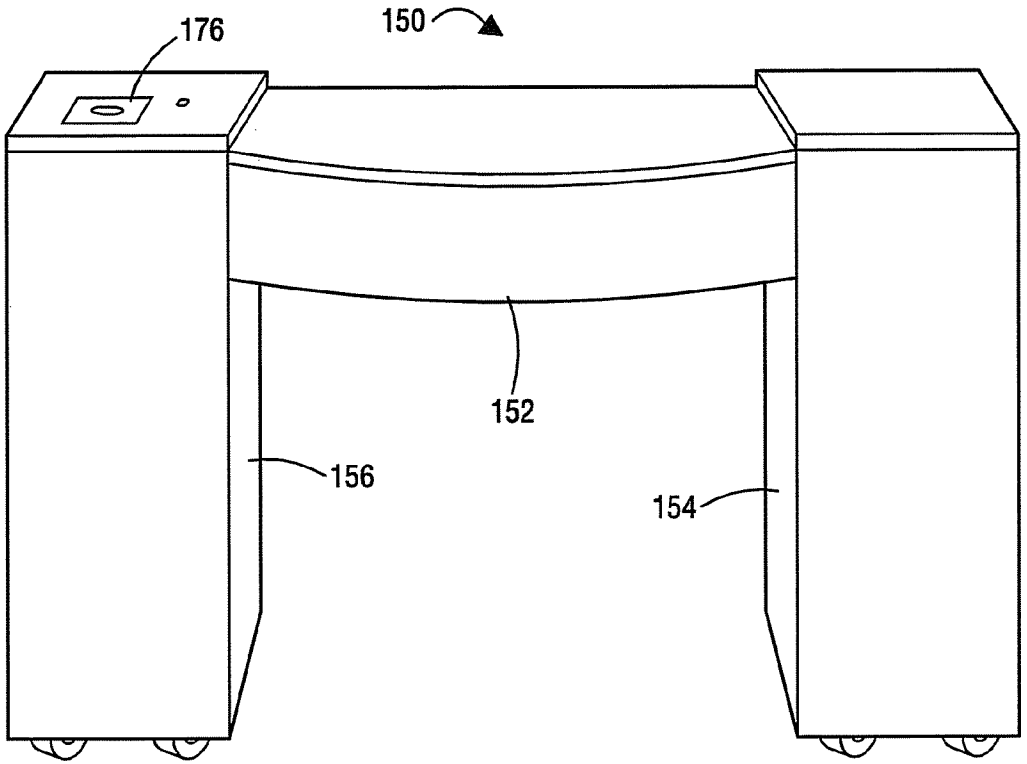
FIG. 2 is a front view of the work station, such as that shown in FIG. 1.

FIG. 2 is a front view of the work station 150, such as that shown in FIG. 1. The center console module 152 and end modules 154, 156 are viewed from the perspective of a customer or person receiving a manicure.

Figure 3:
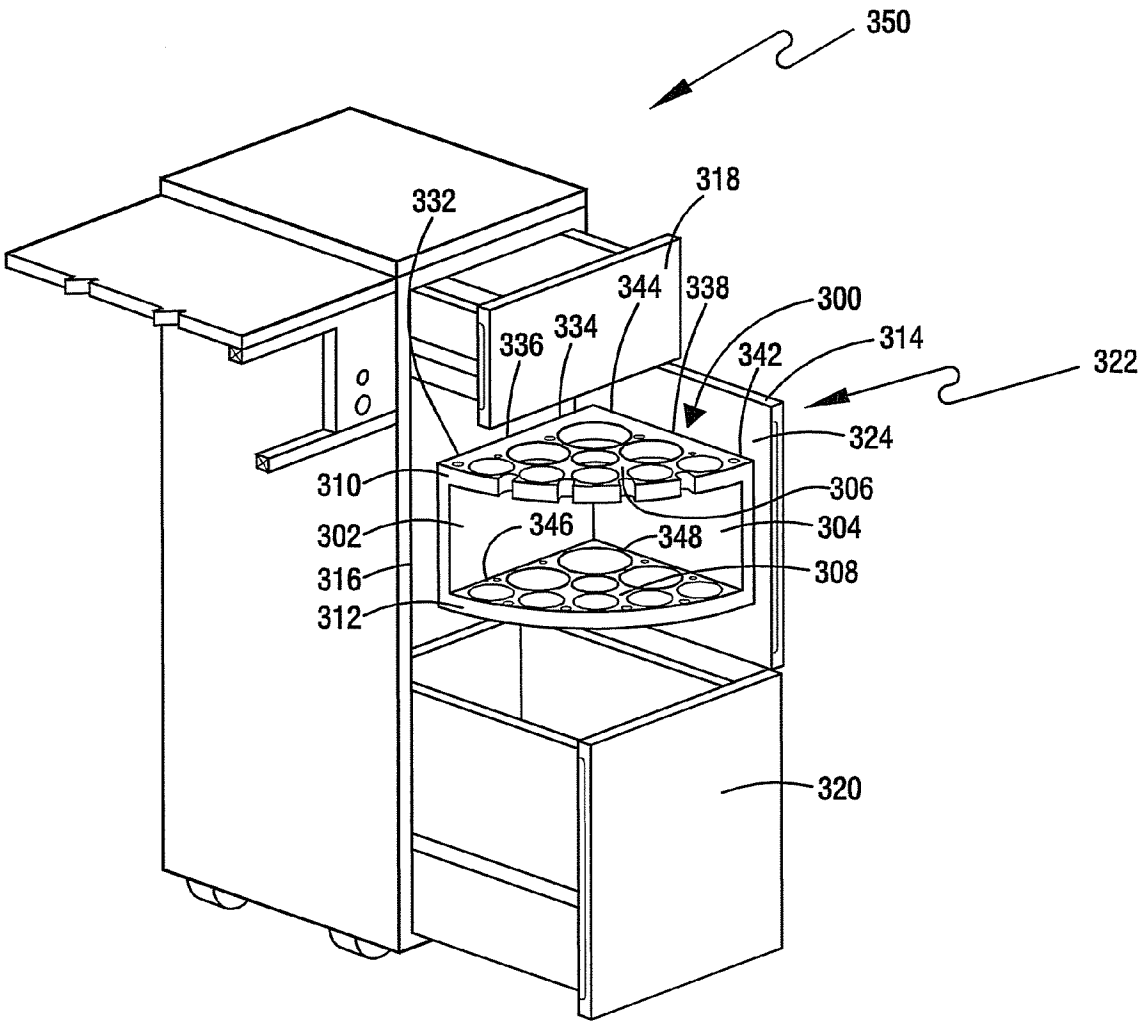
FIG. 3 is a perspective view of an embodiment of an end module of a work station, such as that shown in FIG. 1, having a bottle organizer.

FIG. 3 is a perspective view of an embodiment of an end module 350 of a work station 150, such as that shown in FIG. 1, having a bottle organizer 300. The end module 350 includes top and bottom drawers 318, 320 and a cabinet 322 that houses the bottle organizer 300. The cabinet 322 is placed between the top and bottom drawers 318, 320. In this example, the cabinet 322 includes a door 314 that is coupled to right side walls via at least one hinge (not shown). The inner surface 324 of the cabinet 322 is attached with the bottle organizer 300.

The bottle organizer 300 includes a first sidewall 302 and a second sidewall 304, each having a proximal end 332, 342 and a distal end 334, 344, respectively. The second sidewall 304 is attached to the inner surface of the door 314 of the cabinet 322. The distal end 344 of the second sidewall 304 is attached to the distal end 334 of the first sidewall 302 in a normal position. The bottle organizer 300 further includes a top wall 306 and bottom wall 308 that are attached to the top and bottom portions of the first and second sidewalls 302, 304, respectively.

Figure 4:
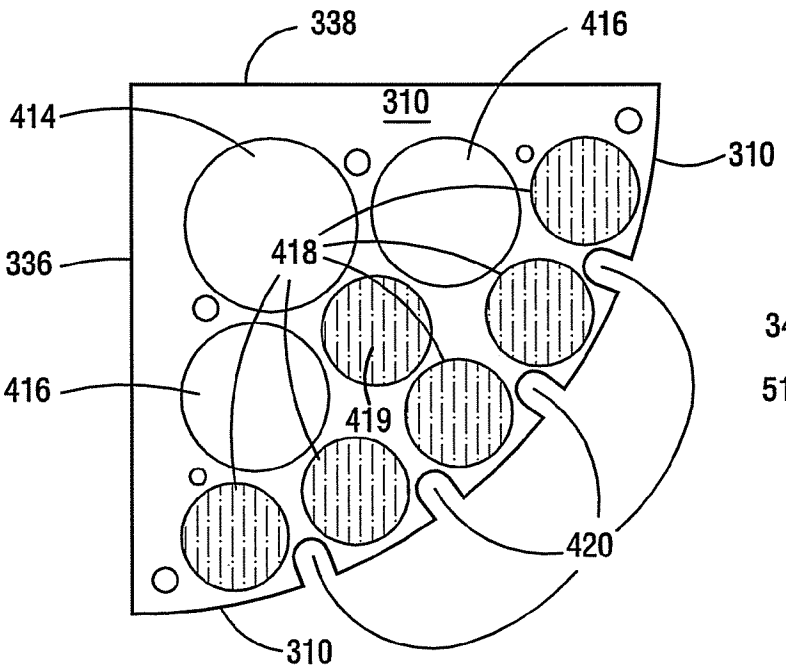

The top and bottom walls 306, 308 of the bottle organizer 300 each having two straight sides 336, 338, 346, 348 and a semi-circular side 310, 312. The inner surfaces at the straight sides 336, 338, 346, 348 of the top and bottom walls 306, 308 are attached to the first and second sidewalls 302, 304, respectively. The semi-circular side 310 of the top wall 306 includes at indentations 420 (FIG. 4). The top and bottom walls 306, 308 have a semi-circular shape, but can have other shapes as can be appreciated. The bottle organizer 300 is further described in relation to FIGS. 4 and 5.

Figure 5:
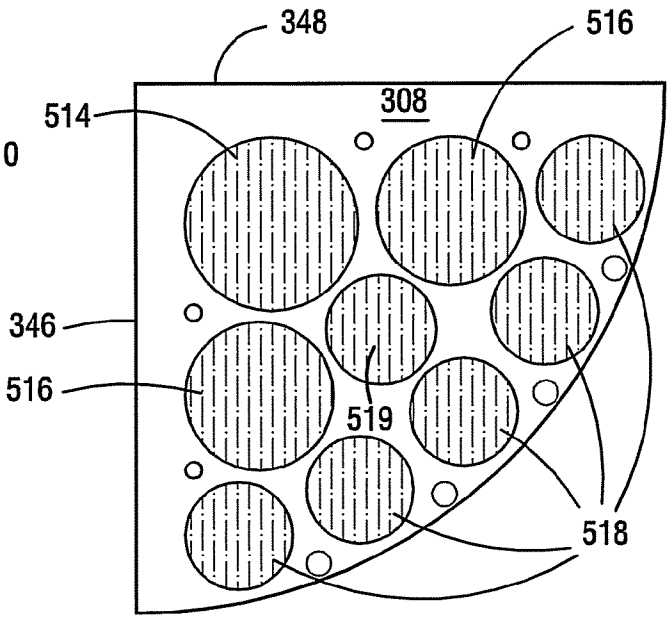
FIGS. 4 and 5 are top views of an embodiment of the top and bottom walls of the bottle organizer, respectively, such as that shown in FIG. 3.

FIGS. 4 and 5 are top views of an embodiment of the top and bottom walls 306, 308 of the bottle organizer 300, respectively, such as that shown in FIG. 3. The top wall 306 includes a first hole 414 and a first set 416 of holes with various diameters. The first hole 414 has a smaller diameter than the first set 416 of holes. The first hole 414 is placed adjacent to the corner where the straight sides 336, 338 connect. The top wall 306 further includes at least one recess 418, 419.

In this example, the at least one recess 418, 419 includes a first recess 419 and first set 418 of recesses. The first set 418 of recesses has a diameter smaller than the first recess and the diameter of the first recess 419 is smaller than the diameter of the first hole 414. The first set 418 of recesses has a diameter smaller than the first recess 419. The first set 418 of recesses is placed adjacent to the semi-circular side 310, which includes indentations 420 that are placed between the first set 418 of recesses. The first set 416 of holes is placed between the first hole 414 and the first set 418 of recesses. The first recess 419 is placed substantially in the center of the top wall 306 surrounded by the first hole 414, first set 416 of holes, and first set 418 of recesses.

The bottom wall 308 includes a first recess 514, second recess 519, a first set 516 of recesses, and a second set 518 of recesses with various diameters. The first set 516 of recesses has a diameter smaller than the first recess 514. The second recess 519 has a diameter smaller than the first set 516 of recesses. The second set 518 of recesses has a diameter smaller than the second recess 519.

In this example, the second set 518 of recesses are placed adjacent to the semi-circular side 312. The first recess 514 is placed adjacent to the corner where the straight sides 346, 348 connect. The first set 516 of recesses is placed between the first recess 514 and the second set 518 of recesses. The second recess 519 is placed substantially in the center of the bottom wall 308 surrounded by the first recess 514, first set 516 of recesses, and second set 518 of recesses. The first recess 514 and the first set 516 of recesses of the bottom wall 308 are aligned with the first hole 414 and first set 416 of holes of the top wall 306, respectively, for containing long bottles or containers that register through the holes 414, 416. The first recess 419 and first set 418 of recesses of the top wall and the second recess 519 and the second set 518 of recesses of the bottom wall 308 contain shorter bottles or containers. The bottles or containers generally store nail products and grooming supplies, such as polishes, and glue, of various sizes, forming a two-tier storage rack. Brushes can be hung on the indentations 420.

In one embodiment, the bottle organizer 300 can hold one 16 ounce bottle, two 8 ounce bottles, and six smaller bottles per tier, such as polishes, glue, and brushes. In another embodiment, the bottle organizer 300 can be mounted on the inside of a cabinet door 314 (FIG. 3) or placed on a counter of the work station 150. In other embodiments, the bottle organizer 300 can be used for keeping kitchen supplies and spices organized in kitchen cabinets or on cupboard shelves.

Figure 6:
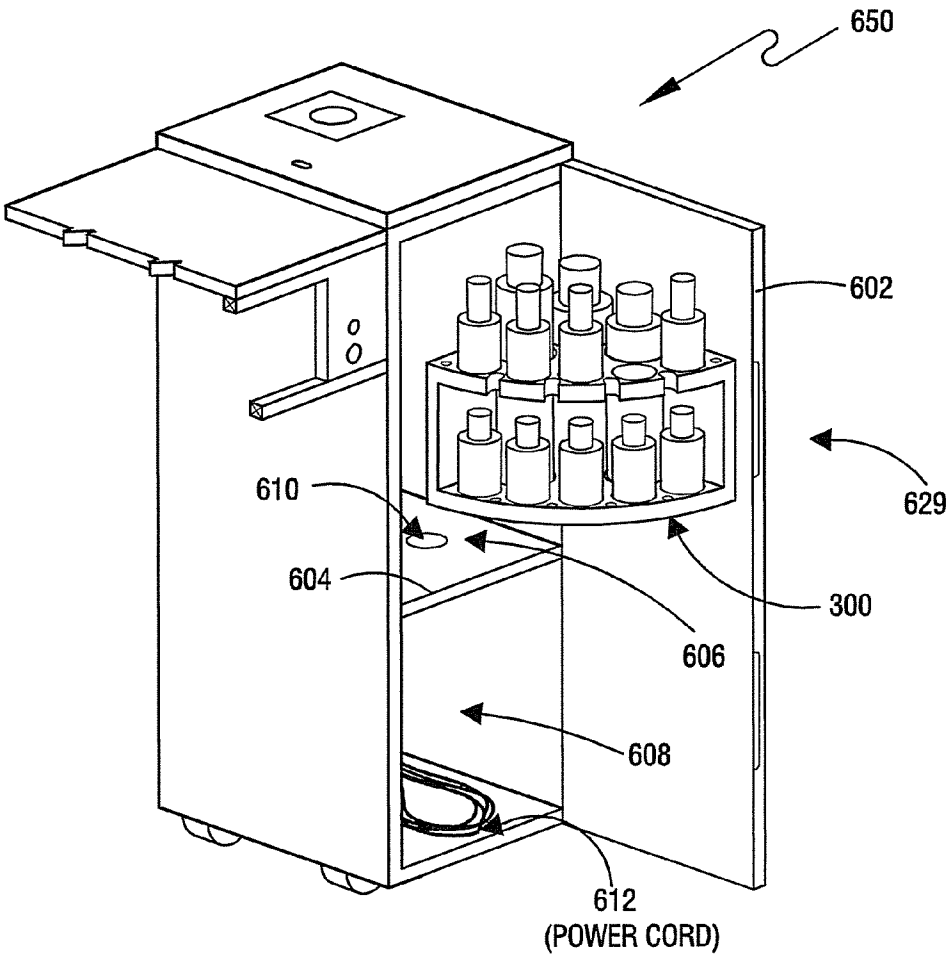
FIG. 6 is a perspective view of another embodiment of an end module of a work station, such as that shown in FIG. 1, having a bottle organizer.

FIG. 6 is a perspective view of another embodiment of an end module 650 of a work station 150, such as that shown in FIG. 1, having a bottle organizer 300. The end module 650 includes a cabinet 629 that includes a door 602, top shelf 606 and bottom shelf 608, the shelves 606, 608 of which are separated by a shelf 604. It should be noted that the shelf 604 can be adjusted to change the height of the top and bottom shelves 606, 608. The shelf 604 includes an electrical port 610 that allows electrical wires to be passed between the top and bottom shelves 606, 608. It should be noted that the portion of the left sidewall of the end module 650 that is connected with the center console module 152 can include a port (not shown) for allowing electrical wires of the nail drill devices to pass through from the center console module 152 to the end module 650. A power cord 612 with at least one outlet can be stored in the bottom shelf 608 that has a port (not shown) on the bottom wall of the end module 650 so that the power cord can be electrically connected to an outlet.

Figure 7:
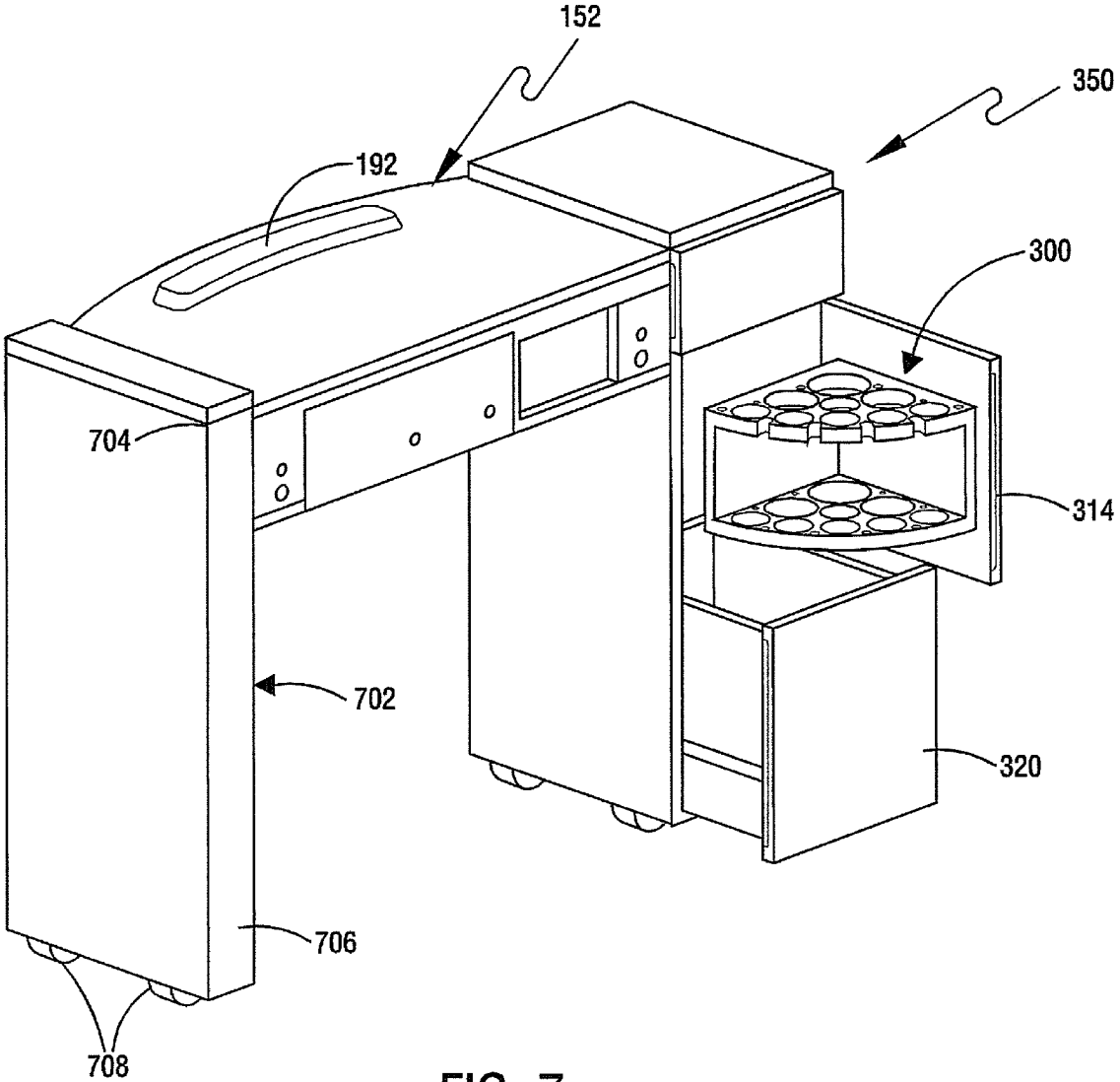
FIG. 7 is a rear view of another embodiment of a work station, such as that shown in FIG. 1, that includes an end module being a flat structure.

FIG. 7 is a rear view of another embodiment of a work station 150, such as that shown in FIG. 1, that includes an end module 702 being a flat structure. The center console module 152 is attached to the end module 350, such as that shown in FIG. 3. The center console module 152 is also attached to the end module 702 that is a flat structure having a proximal end 704 and distal end 706. The proximal end 704 is coupled to the center console module 152 and the distal end 706 is coupled to transporting mechanisms 708, such as casters.

Figure 8:
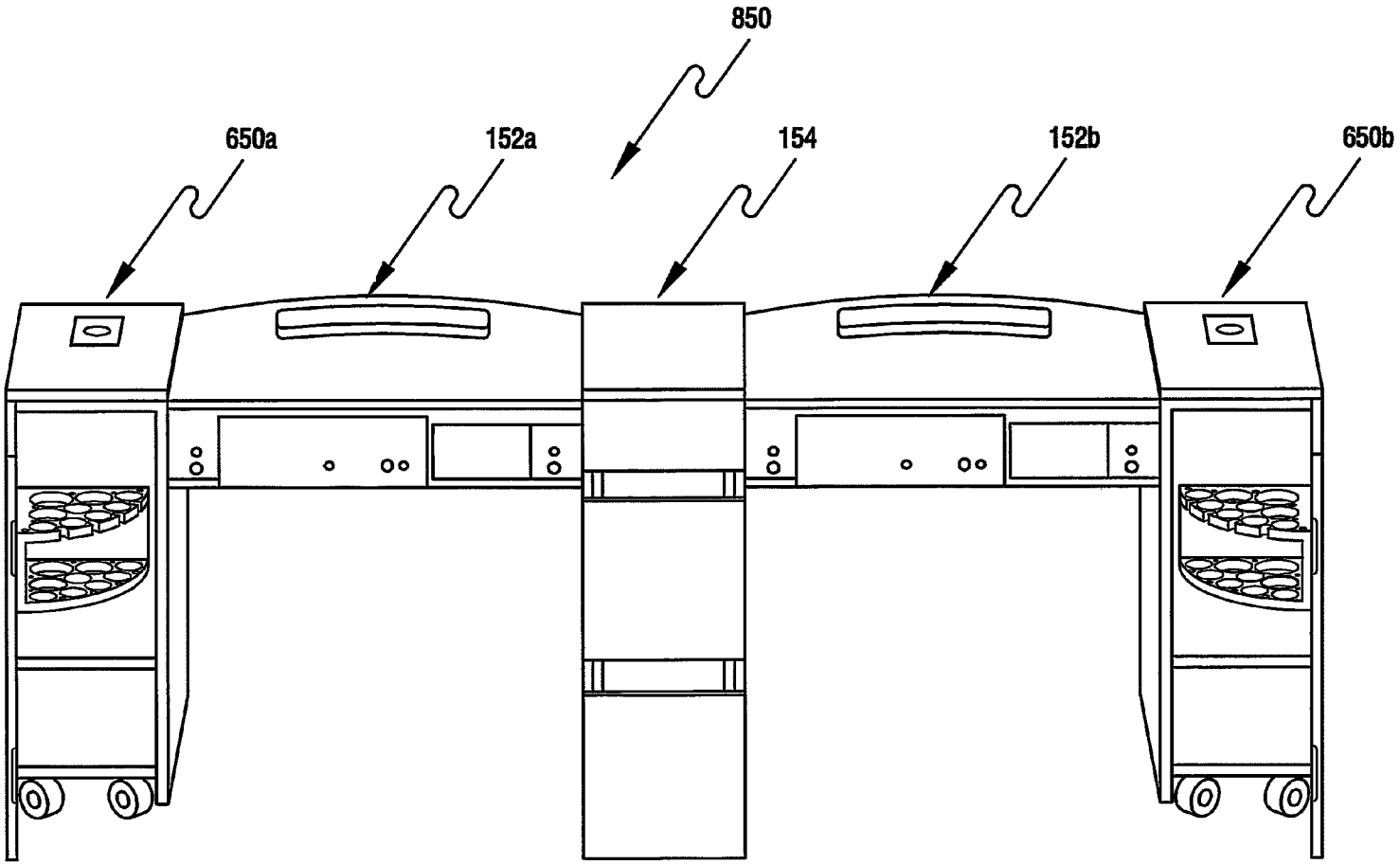
FIG. 8 is a rear view of another embodiment of a work station, such as that shown in FIG. 1, that can be utilized by two manicurists.

FIG. 8 is a rear view of another embodiment of a work station 850, such as that shown in FIG. 1, that can be utilized by two manicurists. The work station 850 includes an end module 154 (FIG. 1) that is placed between two center console modules 152*a*, 152*b*. The left and right ends of the center console modules 152*a*, 152*b* are connected to two end modules 650*a*, 650*b* (FIG. 6), respectively. It should be noted that the cabinet door of the end module 650*a* has been modified to open from right to left and pivot on the left side wall of the end module 650*a*.

Figure 9:
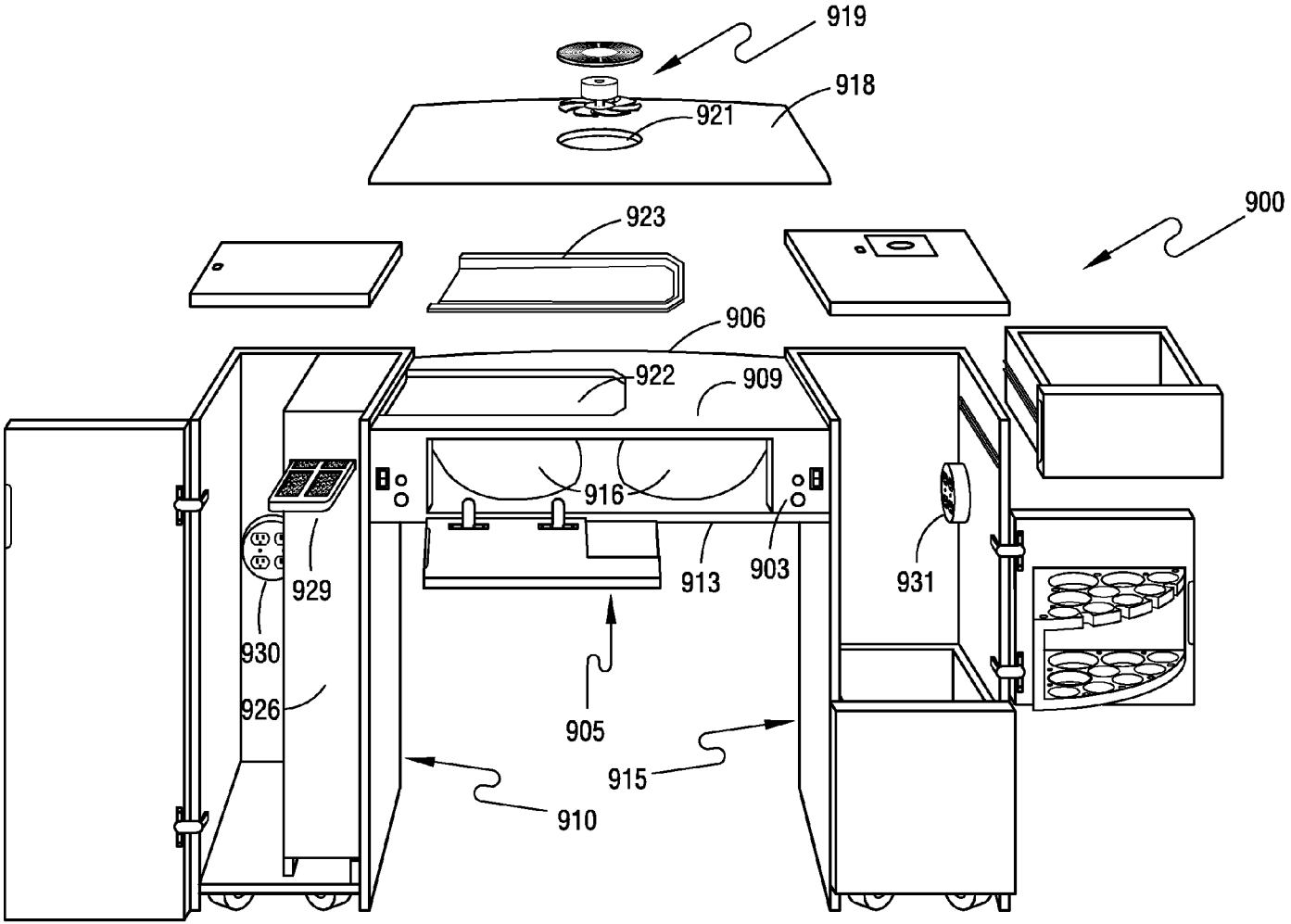
FIG. 9 is a rear view of another embodiment of a work station in accordance with the disclosure.

FIG. 9 is a rear view of another embodiment of a work station 900 in accordance with the disclosure. The work station 900 includes a center console module 905 having a front wall 903, a rear wall 906, a top wall 909, and bottom wall 913. The top wall 909 includes a tray cut-off portion 922 that a tray 923 is placed therein. The tray 923 extends from approximately the center to an edge of the top wall 909 that is adjacent to a first end console 910. The top wall 909 further includes a first airflow device 919, such as, a fan, for producing airflow from the outside to the inside of the center console module 905. A working surface 918 is placed over the top wall 909 and includes a fan opening 921. The first airflow device 919 is placed in the fan opening 921. The tray 923 is positioned below the first airflow device 919 and can receive particles from the first airflow device. The particles can include sanded or grinded finger nails, or grinded natural nails, or grinded gels, among others, as a result of a manicurist working on a customer's finger nails.

The first end module 910 and a second end module 915 are coupled to the center console module 905, forming a "U" shape configuration. The inside of both end modules can be attached with an electrical port 930, 931. The first end module 910 includes a slot 943 (FIG. 11) that aligns with the tray 923 so that particles can move therethrough. It should be noted that the tray 923 includes a bottom surface that slopes up from one edge to another. In general, the tray 923 is positioned such the bottom surface slopes down from the center to the edge of the top wall 909 of the work station 900. The slope assists the particles to flow toward the first end module 910. A particle container 926 is positioned inside the first end module 910 and includes an opening (not shown) that aligns with the slot 943 of the first end module 910 to receive the particles from the tray 923. The particle container 926 includes a filter 929 that slides in and out of the particle container 926. The filter 929 can be replaced with a new filter after the filter 929 is dirty. The filter 929 is generally placed underneath the opening of the particle container 926 that aligns with the slot 943 of the first end module 910 to receive the particles from the tray 923. The filter 929 collects the particles from the tray 923. The particle container 926 includes at least one second airflow device 933, 936, 939 (FIG. 11) that produces airflow from the inside to the outside of the particle container 926. The second airflow device 933, 936, 939 facilitates moving the particles from the tray 923 to the particle container 926.

Figure 10:
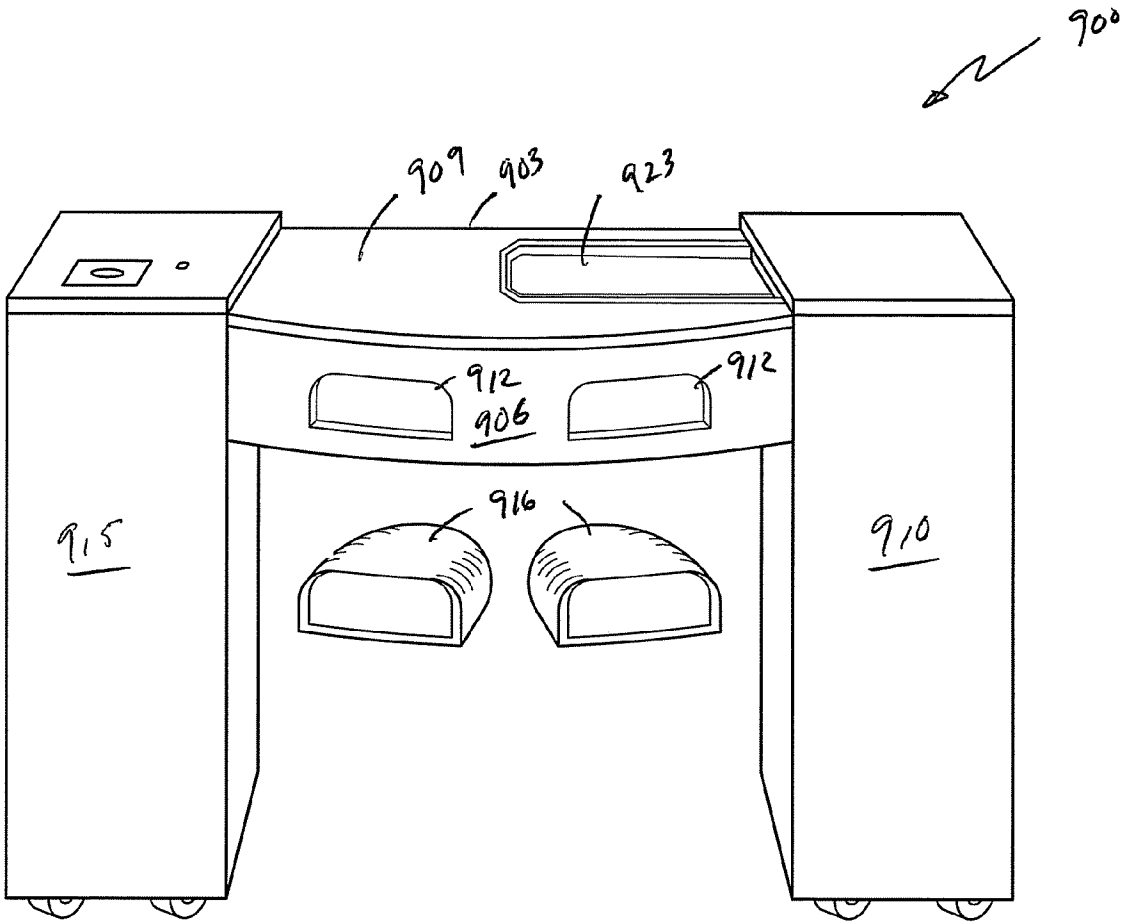
FIG. 10 is a front view of the work station, such as that shown in FIG. 9.

FIG. 10 is a front view of the work station 900, such as that shown in FIG. 9. The front wall includes at least one hole 912 for storing at least one nail drying device 916. The nail drying device 916 can include an ultraviolet (UV) light housed inside the nail drying device 916. After natural nails are placed on a customer's nails with a gel, the customer can put his/her hands in the nail drying device 916 to dry the gel, bonding the natural nails to the customer's nails.

Figure 11:
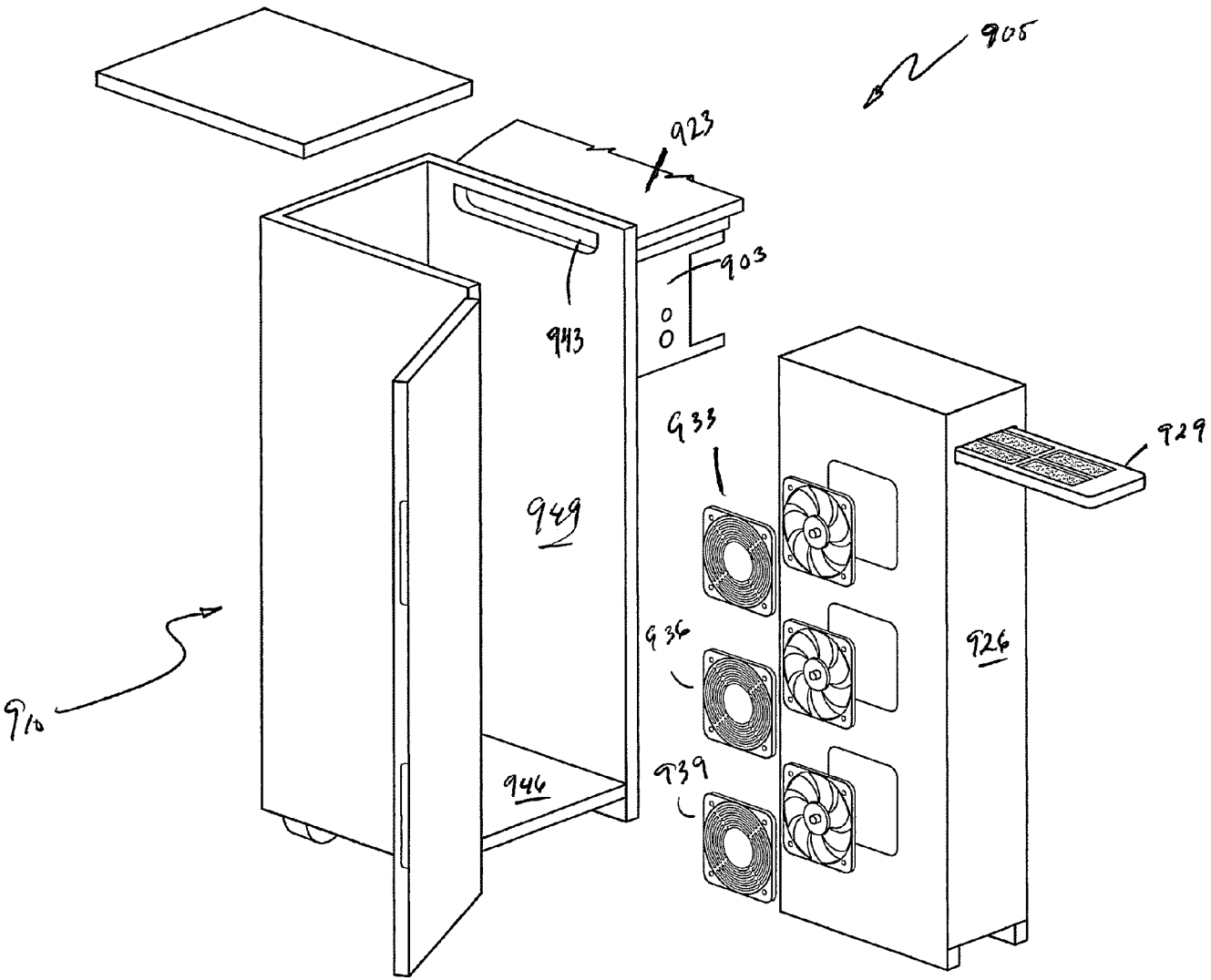
FIG. 11 is a perspective view of an embodiment of an end module of a work station having a particle container, such as that shown in FIG. 9.

FIG. 11 is a perspective view of an embodiment of an end module 910 of a work station 900, such as that shown in FIG. 9, having a particle container 926. The end module 910 includes a slot 943 that aligns with the tray 923 and an opening (not shown) of the particle container 926. The particles move from the tray 923 into the particle container 926 through the slot 943 and opening of the particle container 926.

The particle container 926 includes three holes in which three airflow devices 933, 936, 939 are placed there through. The airflow devices 933, 936, 939 assist generating airflow from the tray 923 to the inside of the particle container 926 and finally through the airflow devices 933, 936, 939. The particle container 926 rests on the bottom wall 946 of the end module 910 and engages the right side wall 949 of the end module 910. The slot 943 of the end module 910 and the opening of the particle container 926 can sealed such that airflow from the tray 923 to the particle container 926 are not lost between the tray 923 and the end module 910 or between the end module 910 and the particle container 926.

An airflow transition seal, such as a silicon sealant, can be used to seal the airflow path at the slot 943 and opening of the particle container 926. The airflow transition seal can further include a plastic tube that extends from the particle container 926 to the tray 923 preventing the particles to escape between tray 923 and end module 910, and between the end module 910 and particle container 926. Alternatively or additionally, it should be noted that the tray 923 can extend through the slot 943 of the end module 910 and the opening of the particle container 926.

This description has been presented for purposes of illustration and description. It is not intended to be exhaustive or to limit the disclosure to the precise forms disclosed. Obvious modifications or variations are possible in light of the above teachings. The embodiments discussed, however, were chosen to illustrate the principles of the disclosure, and its practical application. The disclosure is thus intended to enable one of ordinary skill in the art to use the disclosure, in various embodiments and with various modifications, as are suited to the particular use contemplated. All such modifications and variation are within the scope of this disclosure, as determined by the appended claims when interpreted in accordance with the breadth to which they are fairly and legally entitled.

Therefore, having thus described the disclosure, at least the following is claimed:

1. A work station comprising:

a center console module having front, rear, top, and bottom walls, the top wall having a first airflow device for producing airflow from the outside to the inside of the center console module, the center console module further comprising a tray that includes a bottom surface that is positioned below the first airflow device and adjacent to the top wall of the center console to receive some particles from the first airflow device and to assist the particles to flow toward an edge of the top wall of the center console; and at least two end modules that are coupled to the center console module, the at least two end modules comprising a first end module that receives the particles from the tray at the edge of the top wall of the center console.

2. The work station as defined in claim 1, wherein the first end module includes a particle container that receives the particles from the tray.

3. The work station as defined in claim 2, wherein the particle container includes a filter that collects the particles from the tray.

4. The work station as defined in claim 2, wherein the particle container includes a second airflow device that produces airflow from the inside to the outside of the particle container, wherein the second airflow device facilitates moving the particles from the tray to the particle container.

5. The workstation as defined in claim 1, wherein the end modules include a first end module having front, rear, top, bottom, left and right side walls, the bottom wall being coupled to transporting mechanisms, the rear wall having a cabinet with a door that is coupled to one of the left and right side walls via at least one hinge, the inner surface of the cabinet being attached with a bottle organizer, the top wall being attached with a fan and having holes for hanging a lamp or drill.

6. The work station as defined in claim 5, wherein the bottle organizer includes the following:

a first sidewall having a proximal end and a distal end;

a second sidewall having a proximal end and a distal end, the distal end of the second sidewall being attached to the distal end of the first sidewall in a normal position;

a top wall being attached to top portions of the first and second sidewalls, respectively, the top wall having holes with various diameters, the top wall further having recesses with various diameters; and a bottom wall being attached to bottom portions of the first and second sidewalls, respectively, the bottom wall having first and second sets of recesses with various diameters, the first set of recesses, the first set of recesses being aligned with the holes of the top wall, respectively, for containing items that register through the holes, the recesses of the top and bottom walls being configured to contain items.

7. The work station as defined in claim 5, wherein the cabinet of the first end module includes top and bottom shelves that are separated by a shelf, the shelf having an electrical port that allows electrical wires to be passed between the top and bottom shelves, the portion of the left or right sidewall of the first end module that is connected with the center console module including an electrical port for allowing electrical wires to pass through from the center console module to the first end module.

8. The work station as defined in claim 1, wherein the end modules include a third end module, the third end module being a flat structure having a proximal end and distal end, the proximal end being coupled to one of the side ends of the center console module, the distal end being coupled to transporting mechanisms.

9. The work station as defined in claim 1, wherein the top wall of the center console module includes an arm rest placed adjacent to the front wall of the center console module.

10. The work station as defined in claim 1, wherein the front wall includes at least one hole for storing at least one nail drying device.

11. A work station comprising:

a center console module having front, rear, top and bottom walls, the front wall having at least one hole for storing at least one nail drying device that includes a housing that contains an ultraviolet light bulb for emitting ultraviolet light, the housing of the at least one nail drying device having an opening that substantially conforms to the at least one hole of the front wall, the top wall having a first airflow device for producing airflow from the outside to the inside of the center console module, the center console module further comprising a tray that includes a bottom surface that is positioned below the first airflow device and adjacent to the top wall of the center console to receive particles from the first airflow device and to assist the particles to flow toward an edge of the top wall of the center console; and at least two end modules that are coupled to the center console module.

12. The work station as defined in claim 11, wherein the at least two end modules comprising a first end module that receives the particles from the tray and a second end module that includes a cabinet that is coupled to one of the left and right side walls via at least one hinge, the inner surface of the cabinet being attached with a bottle organizer.

13. The work station as defined in claim 12, wherein the particle container includes a filter that collects the particles from the tray.

14. The work station as defined in claim 12, wherein the bottle organizer includes the following:

a first sidewall having a proximal end and a distal end;

a second sidewall having a proximal end and a distal end, the distal end of the second sidewall being attached to the distal end of the first sidewall in a normal position;

a top wall being attached to top portions of the first and second sidewalls, respectively, the top wall having at least one hole and at least one recess; and a bottom wall being attached to bottom portions of the first and second sidewalls, respectively, the bottom wall having first and second sets of recesses, the first set of recesses being aligned with the holes of the top wall, respectively, for containing items that register through the holes.

* * * * *